US005733469A

United States Patent [19]

Damasse et al.

[11] Patent Number: 5,733,469

[45] Date of Patent: Mar. 31, 1998

[54] NOZZLE FOR INTRODUCING A LIQUID METAL INTO A MOLD FOR CONTINUOUS CASTING OF METALS

[75] Inventors: Jean Michel Damasse, Isbergues; Luc Vendeville, Bethune; Gérard Raisson, Nevers; Laurent Gacher, Sarreguemines, all of France

[73] Assignees: Usinor Sacilor, Puteaux, France; Thyssen Stahl Aktiengesellschaft, Duisburg, Germany

[21] Appl. No.: 718,050

[22] Filed: Sep. 13, 1996

[30] Foreign Application Priority Data

Sep. 28, 1995 [FR] France ..... 95 11375

[51] Int. Cl.[6] ..... B22D 41/08

[52] U.S. Cl. ..... 222/594; 222/606; 222/607

[58] Field of Search ..... 222/591, 594, 222/606, 607

[56] References Cited

FOREIGN PATENT DOCUMENTS 0401144 5/1990 European Pat. Off. .

0453079 10/1991 European Pat. Off. .

60-21171 2/1985 Japan .

111055 1/1989 Japan .

*Primary Examiner*—Scott Kastler

*Attorney, Agent, or Firm*—Sixbey Friedman Leedom & Ferguson; Thomas W. Cole

[57] ABSTRACT

The invention relates to a nozzle for introducing a liquid metal into a mold for continuous casting of metals, of the type comprising a tubular first part, one end of which is intended to be connected to a receptacle enclosing said liquid metal, and the other end of which opens into a hollow second part in which at least one portion of the internal space is oriented substantially perpendicularly to said tubular first part, said portion comprising at each of its ends at least one orifice intended to emerge into the casting space of said mold, which comprises an obstacle placed in the path of the liquid metal inside said tubular first part or in its extension, said obstacle consisting of at least one perforated component intended to divert the metal from its preferential trajectory inside the nozzle.

8 Claims, 2 Drawing Sheets

NOZZLE FOR INTRODUCING A LIQUID METAL INTO A MOLD FOR CONTINUOUS CASTING OF METALS

FIELD OF THE INVENTION

The invention relates to the continuous casting of metals, especially of steel. More precisely, it relates to the tubes made of refractory material, known as "nozzles" which, usually, are connected by their upper end to the receptacle used as storage container for liquid metal, and whose lower end is immersed in the liquid metal melt present in the mold where the solidifying of the metal product is to he initiated. The primary role of these nozzles is to protect the jet of liquid metal from atmospheric oxidation in its travel between the receptacle and the mold. By virtue of appropriate configurations of their lower end, they also make it possible to orient favorably the flows of the liquid metal in the mold in order that the solidifying of the product should take place in the best possible conditions.

The casting may take place in a mold which is to impart to the product a section of very elongated rectangular shape, which is usually referred to by the expression "flat product". In iron and steel manufacture this is the case when steel is cast in the form of slabs, that is to say of products which are approximately 1 to 2 m in width and generally of the order of 20 cm in thickness, but which can go down to a few cm on some recent plants known as "thin slab casting machines". In these examples the mold is made up of stationary walls which are energetically cooled on their face which is not in contact with the metal. Experiments are also being carried out with plants which make it possible to obtain, directly by solidifying the liquid metal, steel strips a few mm in thickness. To do this, use is made of molds in which the casting space is hounded on its large sides by a pair of internally cooled rolls with parallel horizontal axes and rotating about these axes in opposite directions, and on its small sides by closure plates (called side walls) made of refractory material which are applied against the ends of the rolls. The rolls can also be replaced by cooled endless belts.

In molds of these types it is considered that it is preferable to orient the flows of the liquid metal primarily in the direction of the small sides of the casting space. An attempt is thus made, in particular, to obtain a thermal homogenization of the metal so as to attenuate the variations in the thickness solidified along the perimeter of the mold. This thermal homogenization and the stirring of the liquid melt which it requires are particularly crucial in the case of the casting of thin strips, because of the use of the refractory side walls. In fact, if a forced renewal of the metal adjoining these side walls was not ensured, this metal would cool in an abnormally intense manner and undesirable metal solidifications would be seen to appear on the side walls.

PRIOR ART

To obtain the desired homogenization, two-part nozzles (see document JP-A-60021171) are sometimes employed, especially in casting between rolls. The first part is made up of a cylindrical tube whose upper end is connected to an orifice made in the bottom of the distributor which forms the reserve of liquid steel feeding the mold, an orifice which can be shut off at will by the operator, partially or completely, by virtue of a stopper or a slide gate system ensuring the control of the metal flow rate. The maximum flow rate of metal which can flow inside the nozzle depends on the section of this orifice. The second part, secured to the lower end of the above tube, for example by screwing, is intended to be immersed in the liquid metal melt present in the mold. It is made up of a hollow member inside which the lower orifice of the above cylindrical tube opens out. The internal space of this hollow member has a general elongate shape in its end part and is oriented substantially perpendicularly to the tube. When the nozzle is in service the hollow member is placed parallel to the large sides of the mold and the liquid metal flows into the mold through two orifices made at each of the ends of the elongate end part of the hollow member, which are called "nozzle openings".

When a high flow rate of steel, of the order of for example 60 t/h, travels inside the nozzle, the speed of the metal in the tubular park easily reaches several meters per second. In these conditions only a very partial filling of the section of the cylindrical part of the nozzle by the liquid metal is observed. This poor filling has a number of disadvantages. Firstly, owing to a "suction pump effect", it tends to promote the drawing in of external air by the porosities of the refractory and possible defects in the leak tightness of the connection between the nozzle and the distributor, and this deteriorates the quality of the metal. Secondly, above all when the device shutting off the bottom of the distributor is only partially open, the flow of the metal is swirling and nonuniform. This results in a high instability of the metal streams leaving the nozzle openings, an instability which is further increased when an inert gas is blown into the nozzle to attenuate the first disadvantage which was referred to. It is thus possible to observe dissymmetries in the flows which are established on the right and left portions of the mold. This instability and this dissymmetry result in the appearance of waves inside the liquid metal melt in the mold, which continually vary the level of its surface, which is highly unfavorable for the uniformity of the solidifying of the product. These waves also cause the device ensuring the detection of the surface level and the control of its position to react without good cause: it tries to compensate what it takes to be variations in the average level of the metal by ordering rapid and continual alterations in the degree of opening of the stopper or of the slide gate. Furthermore, these incessant alterations will, in fact, aggravate the instabilities of the metal level. Finally, the high speeds of the liquid metal in the nozzle promote wear of the refractory materials of which it is the, in particular at the point of impact of the jet on the bottom of the horizontal hollow member.

SUMMARY OF THE INVENTION

The aim of the invention is to provide metallurgists with nozzles which ensure calmer and more uniform conditions of flow of the metal into the mold than the nozzles usually employed in the continuous casting of metallurgical products.

To this end the invention has as its subject a nozzle for introducing a liquid metal into a mold for continuous casting of metals, of the type comprising a tubular first part, one end of which is intended to be connected to a receptacle enclosing said liquid metal, and the other end of which opens into a hollow second part, at least one portion of the internal space of which is oriented substantially perpendicularly to said tubular first part, said portion comprising at each of its ends at least one orifice intended to open into the casting space of said mold, which comprises an obstacle placed in the path of the liquid metal inside said tubular first part or in its extension, said obstacle consisting of at least one perforated component intended to divert the metal from its preferential trajectory inside the nozzle.

According to a first alternative form of the invention said obstacle consists of at least one disk perforated with a multiplicity of holes.

According to a second alternative form of the invention said obstacle consists of a hollow component provided with a bottom, entering the internal space of said second part of the nozzle, said hollow component comprising openings on its side wall.

In one embodiment of the invention the internal space of the whole of the nozzle is in the general form of a T.

As will have been understood, the invention consists in inserting into the path of the liquid metal an obstacle intended to oppose its natural flow by abruptly diverting this flow from its theoretical preferential trajectory and by locally reducing the section of the space available for the metal to pass through. At an equal metal flow rate, this has the effect of limiting the speed of the flow and of improving the filling of the internal space of the nozzle as a whole. The erratic variations in the conditions of the flow of the metal out of the nozzle are thus attenuated and the symmetry of the flows in the right and left halves of the mold and the uniformity of these flows in time are markedly improved.

BRIEF DESCRIPTION OF THE DRAWINGS

The invention will be understood better on reading the description which follows, which is given with reference to the following appended Figures.

DESCRIPTION OF THE PREFERRED EMBODIMENT(S)

Figure 1A:
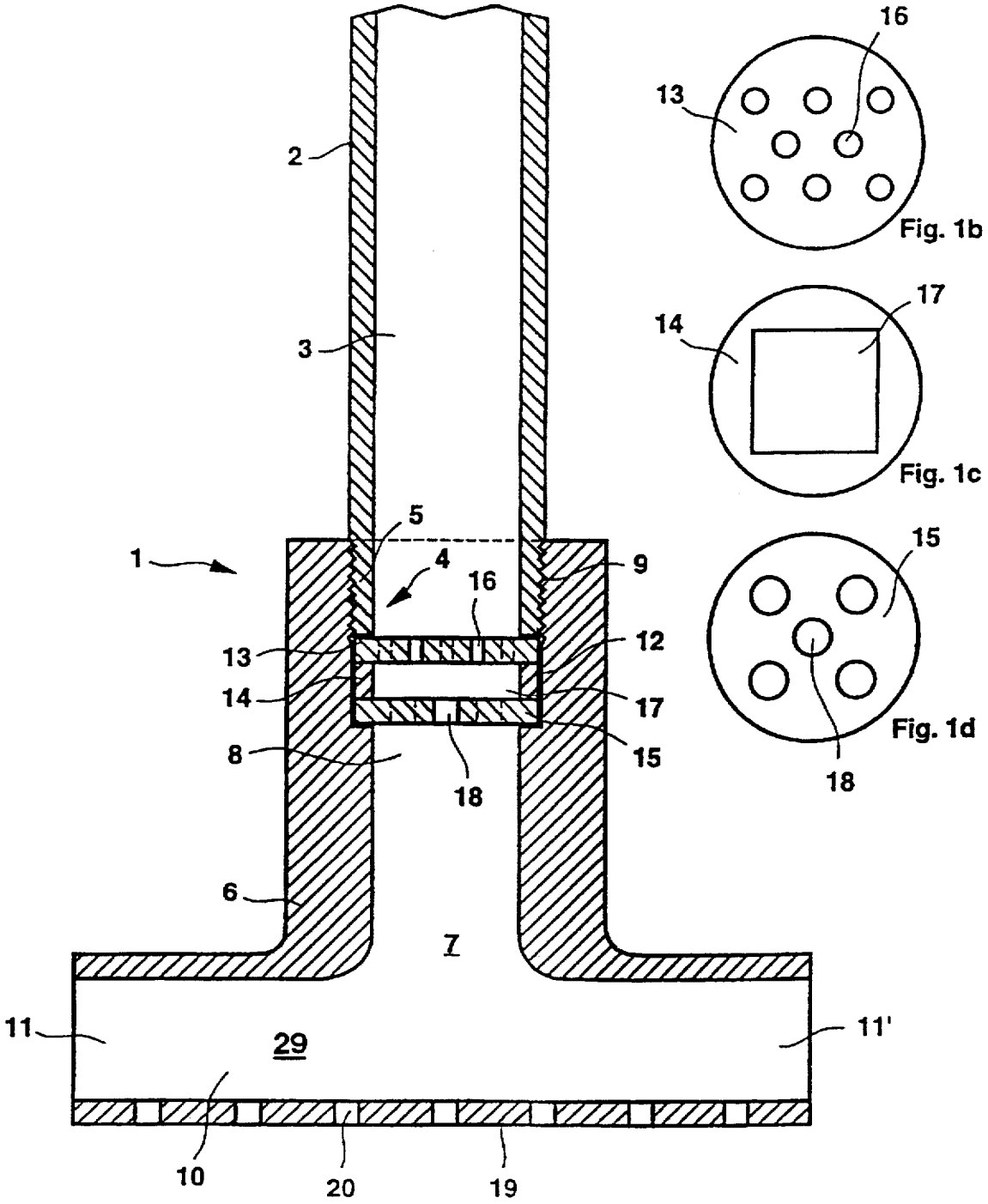
FIG. 1*a* which shows diagrammatically, seen in lengthwise section, a first alternative form of the invention, in which the obstacle consists of a stack perforated disks, which are themselves shown in plan view in FIGS. 1*b*, 1*c* and 1*d*.

In a first example of the embodiment of the invention, shown in FIGS. 1*a*–1*d*, the nozzle 1 is made up, as in the prior art referred to earlier, of two main parts made of a refractory material such as graphited alumina which are in this case assembled together by screwing the first into the second. The first part includes a cylindrical or substantially cylindrical tube 2, the internal space 3 of which forms the passageway for the liquid metal. This tube 2 is normally intended to be held vertically. Its upper part, not shown, is intended to be connected to a receptacle serving as storage container for liquid metal, such as a continuous casting distributor, in line with an orifice through which the liquid metal can flow at a flow rate which the operator regulates by means of a stopper or of a slide gate device. The lower end 4 of the tube 2 comprises threading 5 on its outer wall and this threading 5 enables it to be assembled with the second part of the nozzle 1. This second part is made up of a hollow member 6 which, in the example described and shown, has externally the shape of an inverted T. The internal space 7 of the hollow member 6, itself also in the shape of an inverted T, thus comprises a cylindrical portion 8 extending the internal space 3 of the tube 2. The upper region of this cylindrical portion 8 comprises a widening 9 the wall of which is threaded, so as to make it possible to screw into it the lower end 4 of the tube 2. The cylindrical portion 8 opens into a tubular portion 10 which itself is substantially perpendicular, of approximately circular, oval or rectangular section. Each end of this tubular portion 29 comprises an orifice 11, 11', called a "nozzle opening" through which the liquid metal can flow out of the nozzle. During casting these nozzle openings 10, 11 are intended to be held continually under the surface of the liquid metal filling the casting space.

According to the invention the cylindrical portion 8 of the internal space 7 of the hollow member 6 comprises, inside the widening 9 and under the threading of its wall, a housing 12, in which a stack of three disks made of refractory material can be placed before the two parts 2, 6 of the nozzle 1 are assembled: an upper disk 13, an intermediate disk 14 and a lower disk 15. The respective dimensions of the housing 12 and of the disks 13, 14, 15 are chosen so that, after the nozzle 1 is assembled, the lower end of the tube 2 abuts against the upper disk 13. The upper disk 13 comprises a certain number of perforations 16 distributed over the portion of its surface intended to be situated vertically in line with the internal space 3 of the tube 2. The intermediate disk 14 comprises a single perforation 17, for example square or circular in shape, with an opening which is at least equal to that of the internal space 3 of the tube 2. Its function is, in fact, that of a spacer used to separate the upper 13 and lower 15 disks. The latter itself also has a certain number of perforations 18 which may be different in number and in size from the perforations 16 of the upper disk 13. In order to obtain the required results, however, it is important that the perforations 16 and 18 should be substantially offset in relation to each other, so that a fraction of the liquid metal which is as small as possible is theoretically able to cross the obstacle consisting of the combination of the disks 13, 14, 15 without striking them. For better effectiveness of the obstacle it is also preferable that the upper disk 13 should preferably have no perforation in its middle, where the probability of the presence of liquid metal is the greatest, so as to slow down the casting jet as early as possible.

In general, the total section of the orifices of a given disk must not be smaller than the section of the distributor exit orifice, in order to ensure that it will always be possible to cast with a maximum flow rate of metal which is as high as in the absence of an obstacle.

Optionally, as is already known, the bottom 19 of the hollow member 6 is equipped with perforations 20, called "leakage holes". The usual functions of these leakage holes 20 are to divert a proportion of the metal flows towards the lower part of the mold. This diversion limits the flow rate and the exit speed of the metal at the nozzle openings 11, 11' and thus prevents the metal from violently striking the small sides of the mold and perturbing the solidification conditions therein. In the case of casting between rolls, this also makes it possible to avoid excessive deterioration of the refractory side walls. Furthermore, these leakage holes 20 ensure a uniform feed of hot metal in the lower part of the casting space, particularly in line with the nozzle 1; here again, this tends to promote better control of the solidification conditions. The use of obstacles according to the invention makes it possible to obtain maximum benefit from the advantages provided by the leakage holes 20, insofar as these leakage holes 20 are proportionally more effective the more uniform are the flows inside the nozzle 1 and in particular in the hollow member 6. In particular, this makes it possible to attenuate the preferential flow of the metal through the leakage holes 20 which are closest to the nozzle axis.

By way of example, it may be proposed, in the case of the nozzle 1 in which the internal diameter of the tube 2 is 60 mm and in which the nozzle openings 11, 11' of the hollow member have a circular section and a diameter of 30 mm, to employ an obstacle made up of three disks 13, 14, 15 of 100 mm external diameter and 25 mm thickness, which have the following characteristics:

the upper disk 13 has eight perforations 16 of 13 mm diameter, distributed in two rows of three perforations separated by a row of two perforations;

the intermediate disk 14 has a single perforation 17 which has a square section of 60 mm side or a circular section of 60 mm diameter;

the lower disk 15 has five perforations 18 of 19 mm diameter, namely a central perforation surrounded by four perforations arranged in a square.

In this example, when liquid steel is east, if the metal passes through the nozzle 1 at a flow rate of 60 t/h, it only partially fills the internal space of the tube 2 in the absence of an obstacle. However, the obstacle which has just been described is sufficient to slow down the flow of the liquid steel so as to reduce its speed to approximately 1 m/s and to obtain good filling of the tube 2 as well a metal exit speed which is steady and quite substantially uniform over the whole section of the nozzle openings 11, 11', with the came metal flow rate of 60 t/h. This provides a satisfactory stability of the metal level in the mold when the flow rate of the metal passing through the nozzle 1 is not altered.

The disks must be made of a refractory material such as zirconia, compatible in any event with the nature of the metal which is cast, to prevent them from being excessively attacked chemically by the metal.

of course, the actual type of obstacle with disks which has just been described is merely an example which does not imply any limitation. It is possible to imagine, in particular, employing only a single perforated disk if this is found to be sufficient to obtain an acceptable result in the usual casting conditions or, on the contrary, employing more than three disks to accentuate the effect of slowing down the casting stream. Similarly, the presence of an intermediate disk 14 with a large single perforation 17, which therefore serves merely as a spacer between two disks 13, 15 with multiple small perforations, is not, strictly speaking, essential. However, it makes it possible to limit the wear on the lower disk 15 by avoiding an exclusive concentration of the metal flows on the solid regions of this disk which face the perforations in the upper disk 13.

Figure 2:
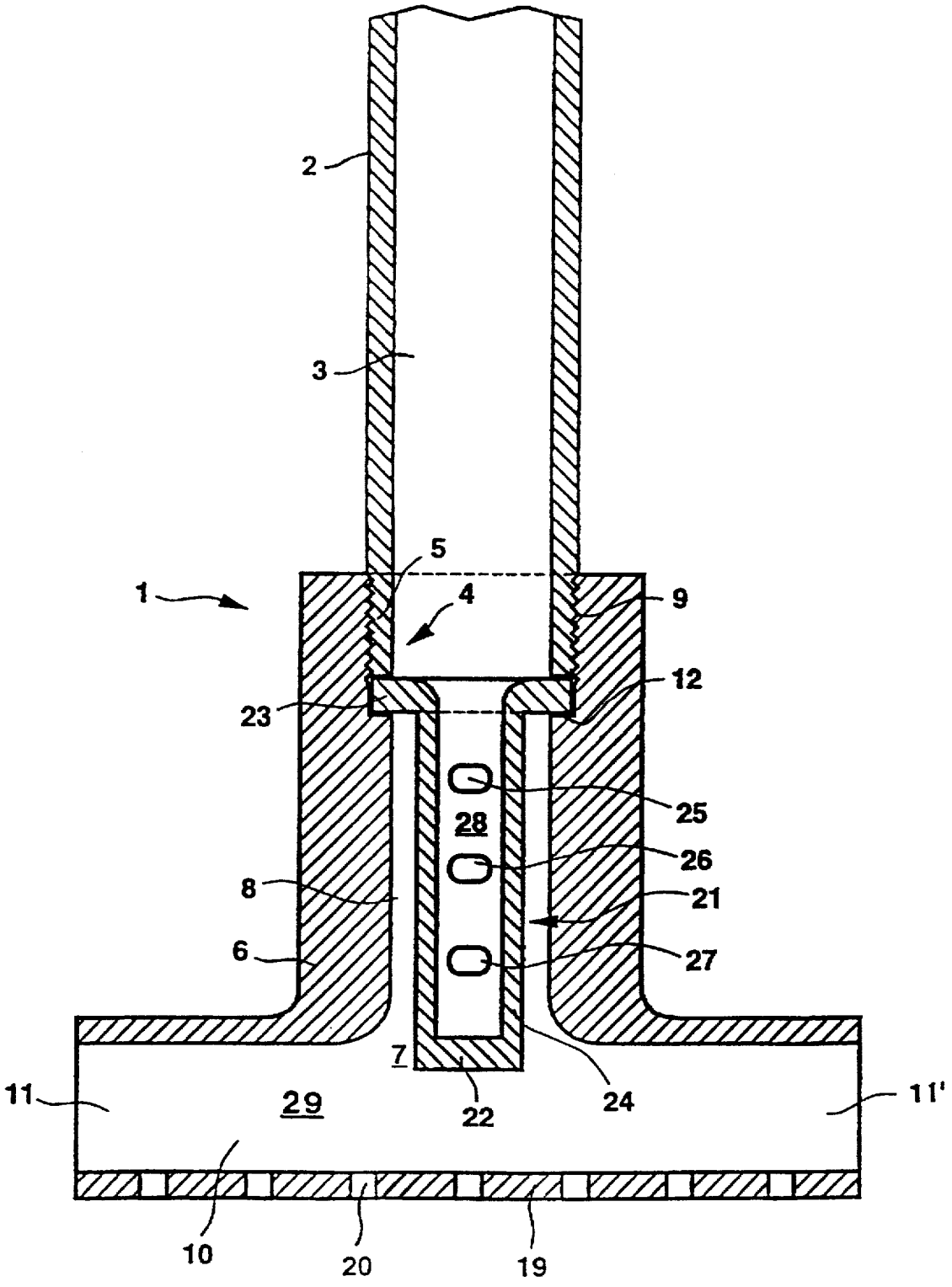
FIG. 2 which shows diagrammatically, seen in lengthwise section, a second alternative form of the invention, in which the obstacle consists of a hollow component extending the tubular first part of the nozzle and directing the metal towards the side walls of the second part of the nozzle.

In a second example of embodiment of the invention, shown in FIG. 2 (in which the members which are common with those in FIG. 1*a* are marked using the same reference signs), the obstacle inserted into the nozzle 1 consists of a tubular component 21 provided with a bottom 22 at one of its ends. At its open end this tubular component 21 has a shoulder 23 which can be inserted into the housing 12 arranged in the hollow member 6 and which contained the disks 13, 14, 15 in the preceding example of embodiment of the invention. On its side wall 24 the tubular component 21 has perforations 25, 26, 27 which allow the liquid metal to pass from the internal space 28 of the tubular component 21 to the internal space 7 of the hollow member 6, after having lost a great proportion of its potential energy. In the example shown in FIG. 2 these perforations 25, 26, 27 are six in number, distributed at three levels over the height of the tubular component 21 and are approximately oval in shape. They make it possible preferentially to direct the liquid metal onto the side wall of the cylindrical portion 8 of the internal space 7 of the hollow member 6. In this way the impact of the metal against the side wall provides an energy absorption which is added to that undergone inside the tubular component 21. Similarly, to obtain a residence time of the metal in the nozzle 1 which is as long and uniform as possible, it is preferable that, as shown, the direction of these perforations should be perpendicular to the direction of the nozzle openings 11, 11'.

By way of example, a tubular component 21 in which the internal space 28 had a length of 84 mm, a diameter of 30 mm and 10×20 mm perforations 25, 26, 27, would have an effect on the speed and the uniformity of the metal flows which is substantially comparable to that of the disks 13, 14, 15 of the obstacle described and shown in FIGS. 1*a* to 1*d*, if it were inserted into an identical nozzle 1.

The examples described above are, of course, not limiting. It would be possible, for example, to imagine inserting the obstacle in the actual interior of the tube 2 and not merely in its extension. It would also be possible to insert into the nozzle 1 a plurality of obstacles similar to those which have been described, or differing in their shape but capable of fulfilling the same functions.

The invention is not limited in its application to the field of the continuous casting of flat products made of steel (slabs, thin slabs, thin strips), even though it finds a prime application therein. It may be applied to many other examples of nozzles for continuous casting of any metals in all formats, in the case of which it is desired to obtain a slowing down of the flows providing better filling of the nozzle and, consequently, greater stability of the liquid metal flows emerging therefrom.

We claim:

1. A nozzle for introducing a liquid metal into a mold for continuous casting of metals, including a tubular first part that defines a first flow path for liquid metal having one end for connection to a receptacle enclosing said liquid metal, and another end which opens into a hollow second part in which at least one portion of an internal space is oriented substantially perpendicularly to said tubular first part, said portion having at each of its ends at least one orifice for opening into a casting space of said mold and through which flows a main proportion of the metal flowing through the nozzle, which comprises an obstacle placed in the path of the liquid metal inside said tubular first part or in an extension thereof, said obstacle including at least one perforated component with a multiplicity of holes for diverting the metal from a preferential trajectory inside the nozzle, and for restricting a flow of liquid metal by defining a second flow path having a cross sectional area that is less than a cross sectional area of the first flow path.

2. The nozzle as claimed in claim 1, wherein said obstacle consists of at least one disk perforated with a multiplicity of holes.

3. The nozzle as claimed in claim 1, wherein said obstacle consists of a plurality of disks perforated with a multiplicity of holes and separated from each other by other disks perforated with a single hole having a cross sectional area approaching internal cross sectional area of said tubular first part.

4. The nozzle as claimed in claim 1, wherein said obstacle consists of a tubular component provided with a bottom, intended to receive the liquid metal inside it, said tubular component comprising perforations in its side wall, said perforations permitting the metal to pass into the internal space of said second part of the nozzle.

5. The nozzle as claimed in claim 4, wherein said perforations are oriented towards the inner wall of said second part of the nozzle.

6. The nozzle as claimed in claim 1, wherein said first part and said second part of the nozzle are assembled by screwing the first part into the second part and in that said obstacle is inserted into a housing arranged in the internal wall of said second part.

7. The nozzle as claimed in claim 1, wherein said portion of the internal space of the second part which is oriented substantially perpendicularly to the first part has an elongate shape, giving the internal space of the whole of the nozzle the general form of a T.

8. The nozzle as claimed in claim 1, wherein the bottom of the hollow part comprises at least one leakage hole.

* * * * *